US005673074A

United States Patent [19]

Miyauchi et al.

[11] Patent Number: 5,673,074

[45] Date of Patent: Sep. 30, 1997

[54] RECORDING APPARATUS HAVING URGING MEMBER TO PREVENT FLOATING OF RECORDING SHEET

[75] Inventors: Yasuo Miyauchi; Hiroshi Tajika; Haruo Uchida, all of Yokohama, Japan

[73] Assignee: Canon Kabushiki Kaisha, Tokyo, Japan

[21] Appl. No.: 164,829

[22] Filed: Dec. 9, 1993

Related U.S. Application Data

[63] Continuation of Ser. No. 747,941, Aug. 21, 1991, abandoned.

[30] Foreign Application Priority Data

| | | | |
|---|---|---|---|
| Aug. 24, 1990 | [JP] | Japan | 2-223268 |
| Sep. 21, 1990 | [JP] | Japan | 2-250300 |
| Sep. 21, 1990 | [JP] | Japan | 2-250301 |

[51] Int. Cl.[6] ..... B41J 2/05; B41J 13/16

[52] U.S. Cl. ..... 347/104; 400/645; 346/134

[58] Field of Search ..... 347/104; 346/134; 400/642, 645

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,521,785 | 6/1985 | Matsufujii | 346/134 X |
| 4,558,333 | 12/1985 | Sugitani et al. . | |
| 4,617,580 | 10/1986 | Miyakawa | 347/105 X |
| 4,698,650 | 10/1987 | Watanabe | 346/134 |
| 4,723,129 | 2/1988 | Endo et al. . | |
| 4,740,796 | 4/1988 | Endo et al. . | |
| 4,900,173 | 2/1990 | Okamura | 346/134 X |
| 4,992,805 | 2/1991 | Yoshizawa | 347/104 X |
| 5,102,247 | 4/1992 | Nagoshi | 400/642 |
| 5,171,006 | 12/1992 | Naito | 346/134 X |
| 5,177,547 | 1/1993 | Kanemitsu et al. | 347/104 X |

FOREIGN PATENT DOCUMENTS

| | | | |
|---|---|---|---|
| 216394 | 4/1987 | European Pat. Off. | B41J 13/00 |
| 3924757 | 2/1990 | Germany | H04N 1/10 |
| 54-56847 | 5/1979 | Japan . | |
| 356056891 | 5/1981 | Japan | B41J 3/22 |
| 358145459 | 8/1983 | Japan | B41J 3/04 |
| 12885 | 1/1984 | Japan | B41J 15/04 |
| 59-123670 | 7/1984 | Japan | B41J 3/01 |
| 59-138461 | 8/1984 | Japan | B41J 3/04 |
| 60-71260 | 4/1985 | Japan | B41J 3/04 |
| 67171 | 3/1988 | Japan | B41J 13/26 |
| 2-293154 | 12/1990 | Japan | B41J 2/01 |
| 41286 | 3/1994 | Japan | B41J 13/10 |

OTHER PUBLICATIONS

IBM Technical Disclosure Bulletin, vol. 23, No. 9, p. 4252, Feb. 1981.

*Primary Examiner*—Joseph W. Hartary
*Attorney, Agent, or Firm*—Fitzpatrick, Cella, Harper & Scinto

[57] ABSTRACT

A recording apparatus comprising a platen for supporting a sheet at a recording area, feeding means for feeding the sheet to the platen, recording means for recording an image on the sheet at the recording area, and an urging member disposed at a downstream side of the recording area and adapted to urge the sheet against the platen. The urging member has an urging surface for urging the sheet against the platen when the recording means is recording the image on the sheet.

78 Claims, 13 Drawing Sheets

RECORDING APPARATUS HAVING URGING MEMBER TO PREVENT FLOATING OF RECORDING SHEET

This application is a continuation, of application Ser. No. 07/747,941 filed Aug. 21, 1991 now abandoned.

BACKGROUND OF THE INVENTION

1. Field of the Invention

The present invention relates to a recording apparatus which can prevent the floating of a recording sheet.

2. Description of the Related Art

In the past, a kind of sheet feeding device incorporated into an ink jet printer and the like comprises a pick-up roller for feeding out sheets stacked in a cassette one by one, a pair of feed rollers for pinching the fed sheet and for feeding the sheet to a platen, and a pair of ejector rollers for removing the sheet from the platen after an image has been printed on the sheet. In this sheet feeding device, the sheet fed out by the pick-up roller is pinched by both feed rollers and the ejector rollers forwardly and rearwardly of the platen, and the recording or printing is effected while a carriage mounting a recording head thereon is scanning the sheet. Meanwhile, the sheet is line-spaced, by means of the rollers, by a predetermined amount for each printing line, and, when all of the printing lines are recorded, the sheet is ejected by the ejector rollers.

However, in such a sheet feeding device, since the printing operation is performed after the sheet is pinched by the feed rollers and the ejector rollers disposed forwardly and rearwardly of the platen, there arose a problem that a blank portion which could not be recorded was left at a leading portion of the sheet.

On the other hand, there are recording apparatuses wherein the recording is started before the leading end of the recording sheet is pinched by the ejector rollers. However, in these recording apparatuses, depending upon the environment such as the surrounding temperature and/or humidity and the recording condition, the leading end of the sheet is curled and floats apart from the platen. As a result, the curled sheet may contact the recording head and smear the sheet or may ride over the ejector rollers or may be folded at its leading end. In order to prevent the leading end of the sheet from floating there were proposed an electrostatic attracting means or a suction means such as a pump disposed on or in the platen. However, such means made the apparatus expensive and large-sized.

Further, in the past, as shown in FIG. 22, an elastic sheet hold-down member 50 is attached to a fixed guide 52 for guiding the movement of a carriage 51 whereby the sheet hold-down member 50 holds down a recording sheet 54 at a recording area below a recording head 53 to prevent the floating of the sheet 54.

However, if the sheet hold-down member 50 always contacts with the recording sheet 54 as shown in FIG. 22, the accuracy of the feeding of the sheet will often be decreased. Further, if the leading end of the recording sheet 54 is curled upwardly, the leading end of the recording sheet is floated before the leading end is pinched by a pair of ejector rollers 56, thus resulting in unwanted contact between the recording sheet 54 and the recording head 53. To avoid this, the recording operation is effected after the leading end of the recording sheet has been pinched by the ejector rollers, thus generating a longer blank area at the leading end portion of the recording sheet.

SUMMARY OF THE INVENTION

An object of the present invention is to provide a recording apparatus which can eliminate the above-mentioned conventional drawbacks, to prevent the floating of a recording sheet without decreasing the accuracy of feeding the recording sheet, to minimize a blank portion on which the recording is not effected, and to prevent the contamination of the recording sheet with ink.

In order to achieve the above object, the present invention provides a recording apparatus comprising a recording means for performing the recording with respect to a recording sheet fed onto a platen, and a sheet hold-down member disposed at a downstream side of the platen and adapted to urge the recording sheet against the platen.

DETAILED DESCRIPTION OF THE PREFERRED EMBODIMENTS

Figure 1:
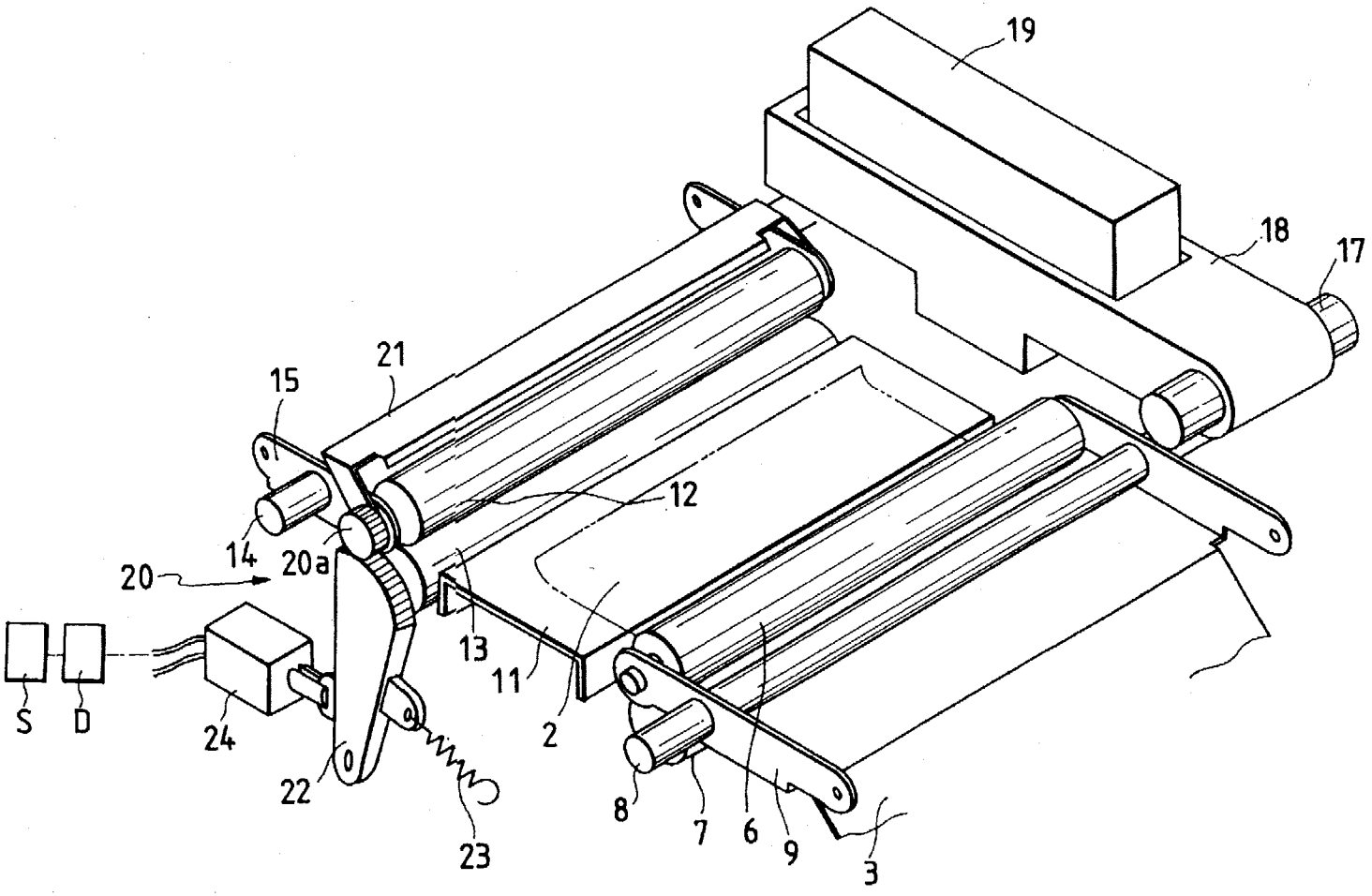
FIG. 1 is a perspective view of a recording apparatus according to a preferred embodiment of the present invention.
Figure 2:
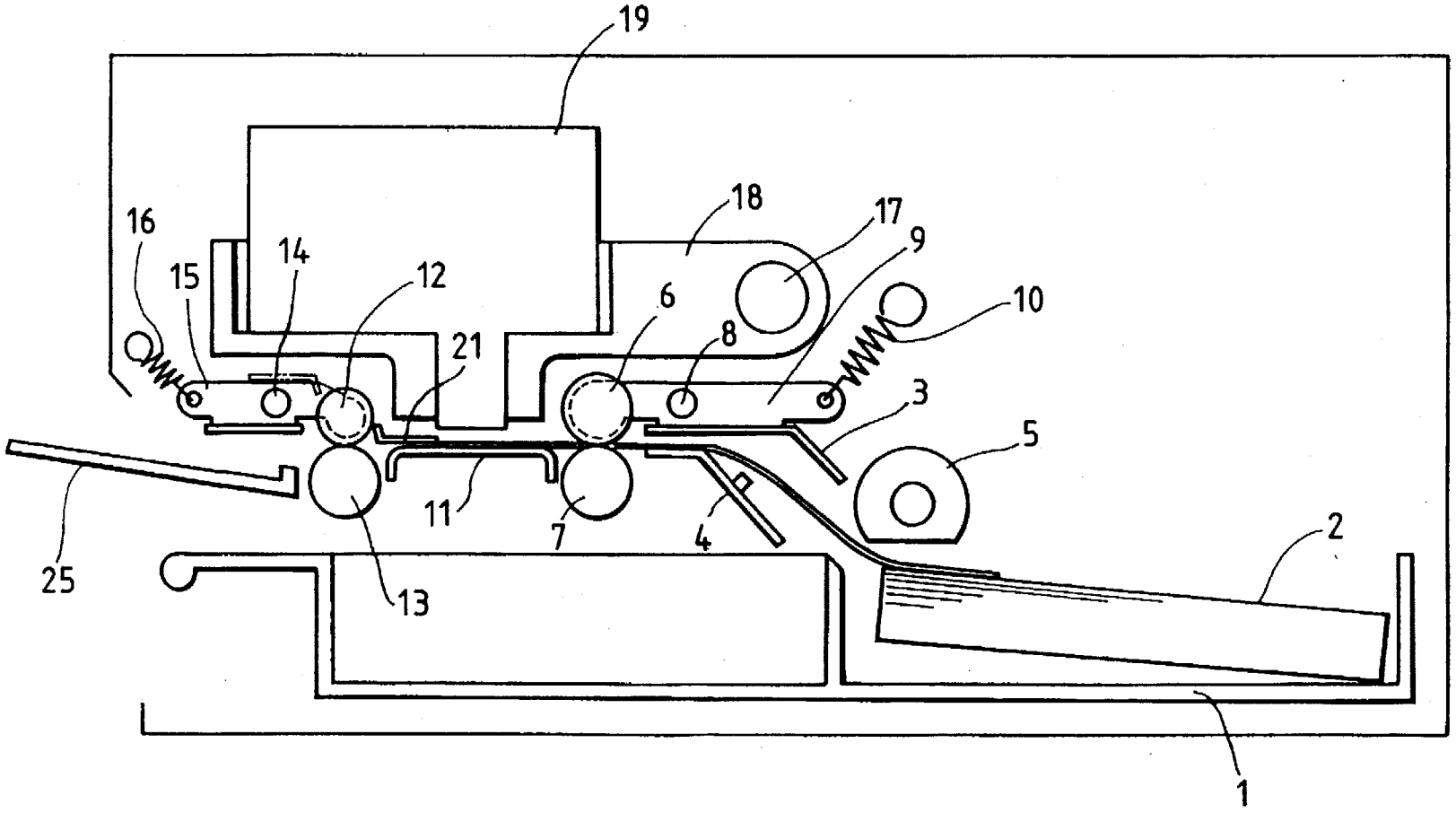
FIG. 2 is an elevational sectional view of the recording apparatus of FIG. 1.

FIGS. 1 and 2 are a sectional view and a perspective view of a recording apparatus according to a first embodiment of the present invention, respectively.

A pick-up roller 5 is provided for separating an uppermost sheet from sheets 2 stacked in a cassette 1 and for supplying and feeding the uppermost sheet between an upper guide 3 and a lower guide 4. Whenever the pick-up roller 5 is rotated by one revolution, it is stopped at a position shown in FIG. 2 to release a sheet feeding force; however, before the completion of one revolution of the pick-up roller, a leading end of the sheet is pinched between an upper feed roller 6 and a lower feed roller 7. Thereafter, the sheet is conveyed by these upper and lower feed rollers 6, 7. The upper feed roller 6 is urged against the lower feed roller 7 by a spring 10 via a pressure plate 9 pivotally mounted on a shaft 8, so that the upper feed roller 6 is driven in synchronously with the rotation of the lower feed roller 7. When the sheet 2 is detected by a sensor S, the lower feed roller 7 starts to be rotated by a pulse motor (not shown) to feed the sheet 2 step by step.

At a downstream side of a platen 11, there are disposed upper and lower ejector rollers 12, 13 which cooperate with each other to pinch the fed sheet 2 therebetween. The upper ejector roller 12 is urged against the lower ejector roller 13 by a spring 16 via a pressure plate 15 pivotally mounted on a shaft 14, so that the upper ejector roller 12 is driven synchronously with the rotation of the lower ejector roller 13. Further, since it is so selected that the lower ejector roller 13 is rotated at a peripheral speed faster than that of the lower feed roller 7 by a few percent (%), the sheet 2 on the platen 11 is always tensioned properly to prevent slack.

Above the platen 11, there is disposed a movable carriage 18 which can be shifted along a rail 17 arranged transversely to a sheet feeding direction and on which a recording head (recording means) 19 is mounted.

Next, a sheet hold-down member 20 which forms a part of the present invention will be explained.

A gear 20*a* is rotatably mounted on a same axis as that of the upper ejector roller 12, and a sheet hold-down plate 21 capable of being urged against the platen 11 is secured to the gear 20*a*. A rotatable gear lever 22 is meshed with the gear 20*a*. A return spring 23 and a solenoid 24 are attached to the gear lever 22 at opposite sides thereof. When the solenoid 24 is not energized, the sheet hold-down plate 21 is situated at a position (shown in FIG. 1) spaced apart from the platen 11 by means of the return spring 23; whereas, when the solenoid 24 is energized, the gear lever 22 is rotated to rotate the gear 20*a*, thereby urging the sheet hold-down plate 21 against the platen 11.

Next, an operation of the apparatus according to the embodiment having the above-mentioned arrangement will be explained.

The uppermost sheet on the sheet stack 2 resting in the cassette 1 is fed out by the pick-up roller 5. The fed sheet 2 is guided between the upper and lower guides 3, 4 and is then pinched by the upper and lower feed rollers 6, 7, and then is fed onto the platen 11. In this case, the carriage 18 on which the recording head 19 is mounted is waiting at a side of the platen 11. As shown by a phantom line in FIG. 1, the leading end of the sheet 11 fed on the platen 11 is often curled to float from the platen. When the leading end of the sheet reaches a position where the leading end of the sheet is held down by a central portion (in the sheet feeding direction) of the sheet hold-down plate 21, as determined or discriminated by counting the pulse numbers of the pulse motor for driving the feed roller 7 by means of a counter means D, the solenoid is energized to generate the attraction force, thereby rotating the gear lever 22. As a result, the sheet hold-down plate 21 is also rotated via the gear 20*a*, thus urging the leading end of the sheet 2 against the platen 11.

In this condition, the carriage 18 mounting the recording head 19 thereon performs the scanning action along the rail 17 to print one line. In this way, it is possible to minimize a blank portion at the leading end portion of the sheet. After the one-line printing is finished, the sheet 2 is fed by a predetermined amount (line spaced) to prepare for the next one-line of printing. In this case, by feeding the sheet step by step while the sheet hold-down plate 21 is being urged against the sheet 2, the leading end of the sheet can be smoothly pinched between the upper and lower ejector rollers 12, 13. That is to say, if the sheet hold-down plate 21 is released or opened, the leading end of the sheet will float again. In this condition, if the sheet is further fed, the sheet will ride up on the upper ejector roller 12 or the front corner or corners of the sheet will be folded. However, by providing the sheet hold-down plate 21, such an inconvenience can be avoided.

After the sheet 2 is pinched between the upper and lower ejector rollers 12, 13, as discriminated by counting the pulse numbers of the motor driving the lower feed roller 7, since the sheet hold-down plate is no longer, when the recording head 19 returns to its waiting position, the attraction force of the solenoid 24 is released, with the result that the sheet hold-down plate 21 is retarded, or retracted, by the return spring 23, to a position where the sheet hold-down plate does not interfere with the scanning action of the carriage 18.

After the printing of the desired whole area of the sheet is finished by repeating the line spaces of the sheet and the one-line printings by means of the recording head 19, the sheet 2 is ejected onto an ejection tray 25 by the ejector rollers 12, 13, thus completing the sequential printing operation.

Incidentally, when a sheet such as a plastic sheet on which the drying of the ink is delayed is used as the recording sheet, a mode wherein the solenoid 24 is not retarded (i.e., the attraction force thereof is not released) may previously be selected so that the sheet hold-down plate 21 is not smeared with the non-dried ink. Further, as proposed in the Japanese Patent Laid-open No. 2-293154, the upper ejector roller may be divided into plural roller portions in an axial direction, and only roller portions associated with the printing area may be pivoted to be separated from the lower ejector roller.

Figure 6:
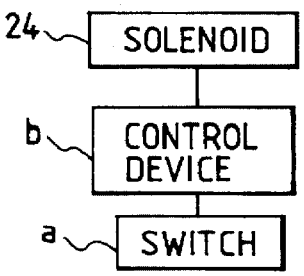
FIGS. 6 and 7 are block diagrams for the mode setting.

The selection of this mode is effected as follows:

As shown in FIG. 6, a switch a is manipulated depending upon the material of the sheet 2, and the solenoid 24 is controlled via a control device b on the basis of a signal from the switch. That is to say, the sheet hold-down plate 21 is released without the energization of the solenoid 24.

Figure 7:
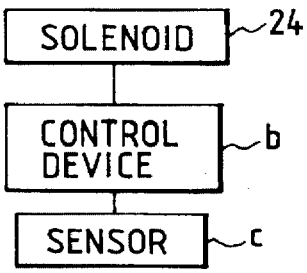

Alternatively, as shown in FIG. 7, a sensor c may determine whether the material of the sheet 2 can pass light, indicating, for example, a plastic recording sheet, so that the solenoid 24 can be controlled by the control device b.

Figure 3:
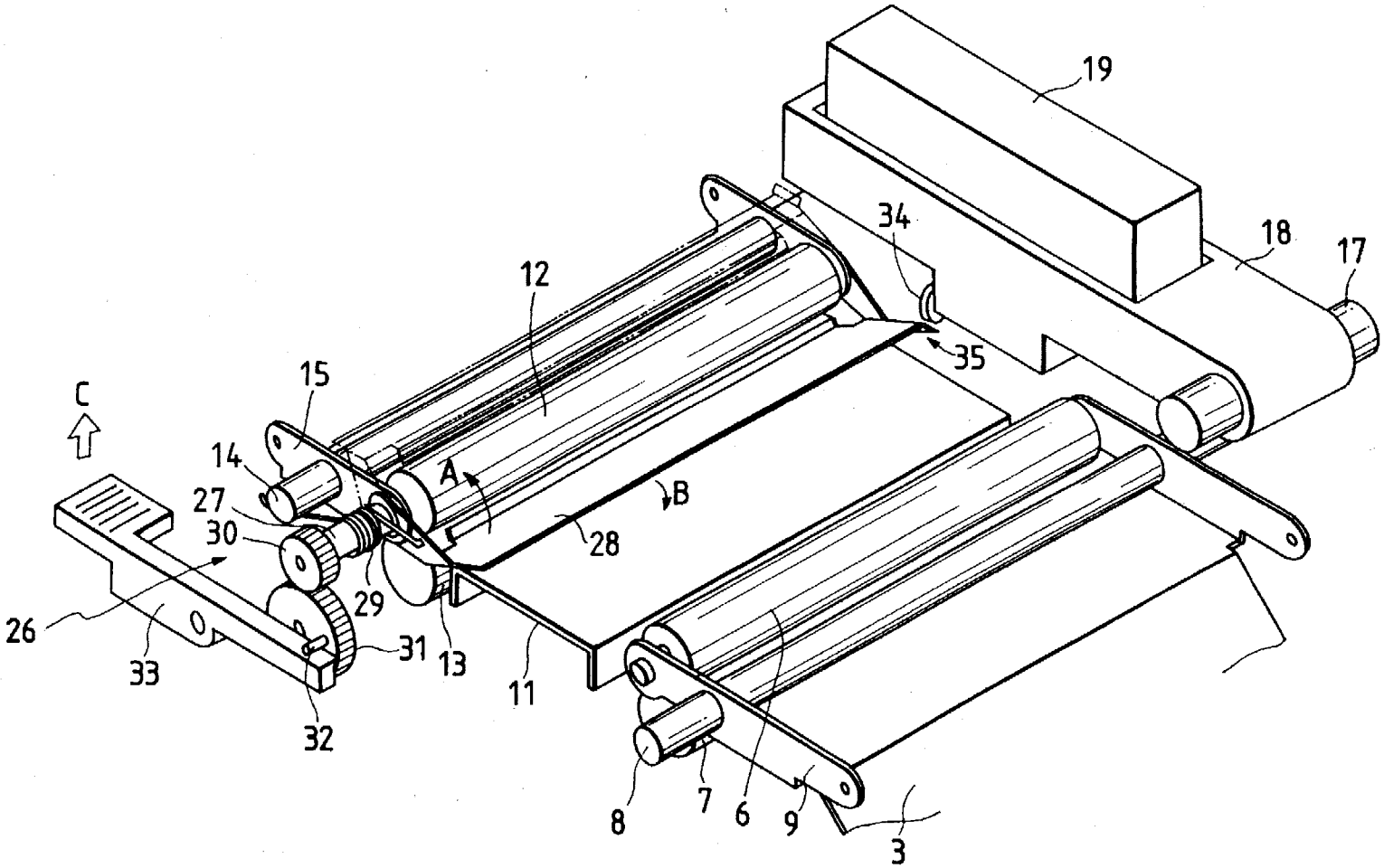
FIG. 3 is a perspective view of a recording apparatus according to a second embodiment of the present invention.
Figure 4:
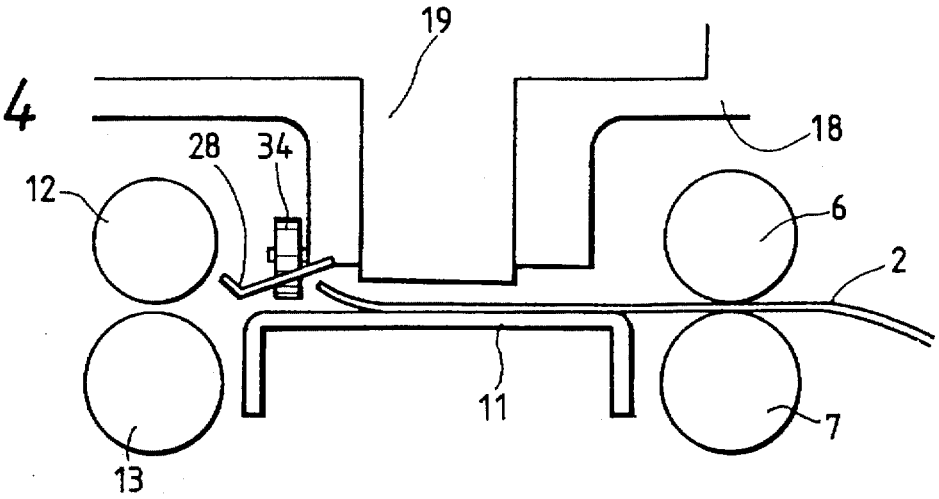
FIGS. 4 and 5 are elevational sectional views showing the operation of a sheet hold-down member.
Figure 5:
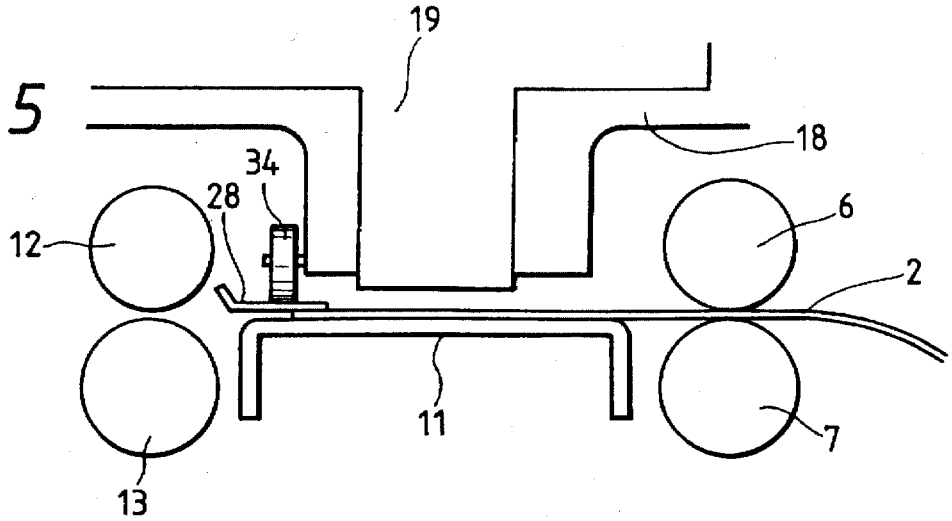

FIGS. 3 to 5 show a second embodiment of the present invention. Since this second embodiment is the same as the above-mentioned first embodiment except for the construction of a sheet hold-down portion 26, only the differences will be explained.

A sheet hold-down plate 28 is fixedly mounted on a shaft 27 rotatably arranged on an axis same as that of the upper sheet ejector roller 12. Further, a torsion coil spring 29 is disposed around the shaft 27, which spring always biases the sheet hold-down plate 28 in a direction shown by the arrow A in FIG. 3. A gear 30 secured to an end of the shaft 27 is meshed with a gear 31. A pin 32 protruding from an end surface of the gear 31 can be engaged by a lever 33 arranged at a side of the gear 31 so that the gear 30 and the sheet hold-down plate 28 are held at a predetermined position. In this predetermined position, the sheet hold-down plate 28 is separated from the platen 11 and can be pivoted only in a direction shown by the arrow B in FIG. 3.

A roller (urging means) 34 rotatably mounted on the carriage 18 serves to urge the sheet hold-down plate 28 against the platen 11 by riding on the plate 28 when the carriage is shifted to a position over the platen 11. Further, the sheet hold-down plate 28 is provided with an inclined end portion 35 for facilitating the riding of the roller 34 on the sheet hold-down plate 28.

Next, the operation of the recording apparatus having the above-mentioned construction according to this embodiment will be explained.

If the leading end of the sheet 2 fed on the platen 11 is curled upwardly as shown in FIG. 4, since the sheet hold-down plate 28 is separated from (i.e., open to) the platen 11, the curled leading end of the sheet can be directed below the sheet hold-down plate 28. And, when the sheet 2 is fed to the predetermined position as in the first embodiment, the carriage 18 which is waiting at the side of the platen 11 is shifted along the rail 17, with the result that the roller 34 will ride on the sheet hold-down plate 28 while rolling. Consequently, as shown in FIG. 5, the leading end of the sheet 2 is urged against the platen 11 by the roller 34 via the sheet hold-down plate 28, thus providing the proper printing condition of the sheet. Thereafter, the printing lines are sequentially recorded on the sheet 2.

If a plastic sheet on which the ink is hard or slow to dry is used as the recording sheet, the lever 33 is rotated in a direction shown by the arrow C in FIG. 3 so that the sheet hold-down plate 28 is retarded to a position shown by a phantom line in FIG. 3 (i.e., a position where the sheet hold-down plate does not interfere with the scanning action of the carriage), thus preventing contact between the sheet hold-down plate 28 and the sheet 2.

Incidentally, in the illustrated embodiment, while the sheet hold-down plate could be pivoted, it may be translated in an up-and-down direction.

Figure 8:
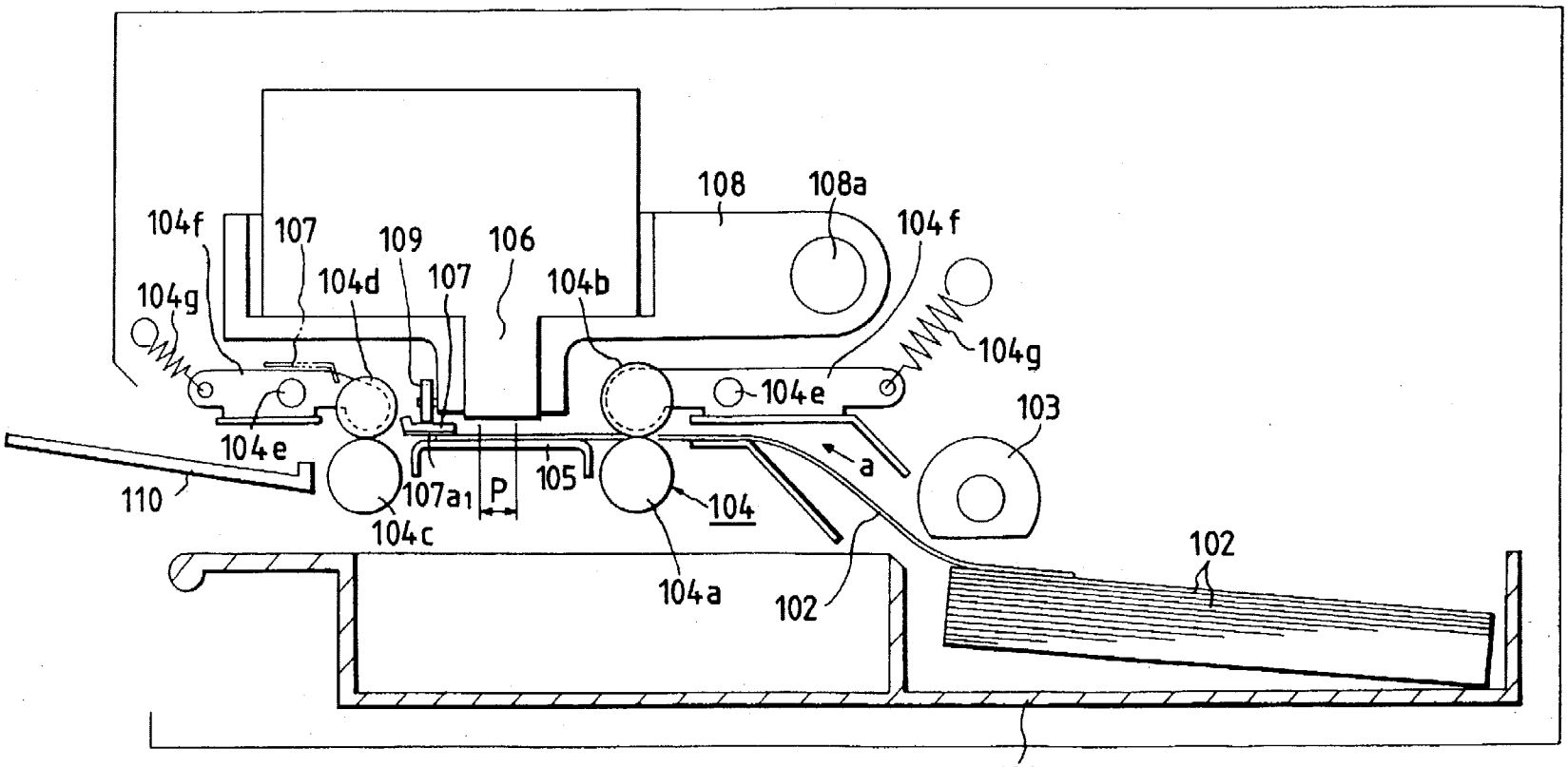
FIG. 8 is an elevational sectional view of an ink jet recording apparatus according to a third embodiment of the present invention.
Figure 9:
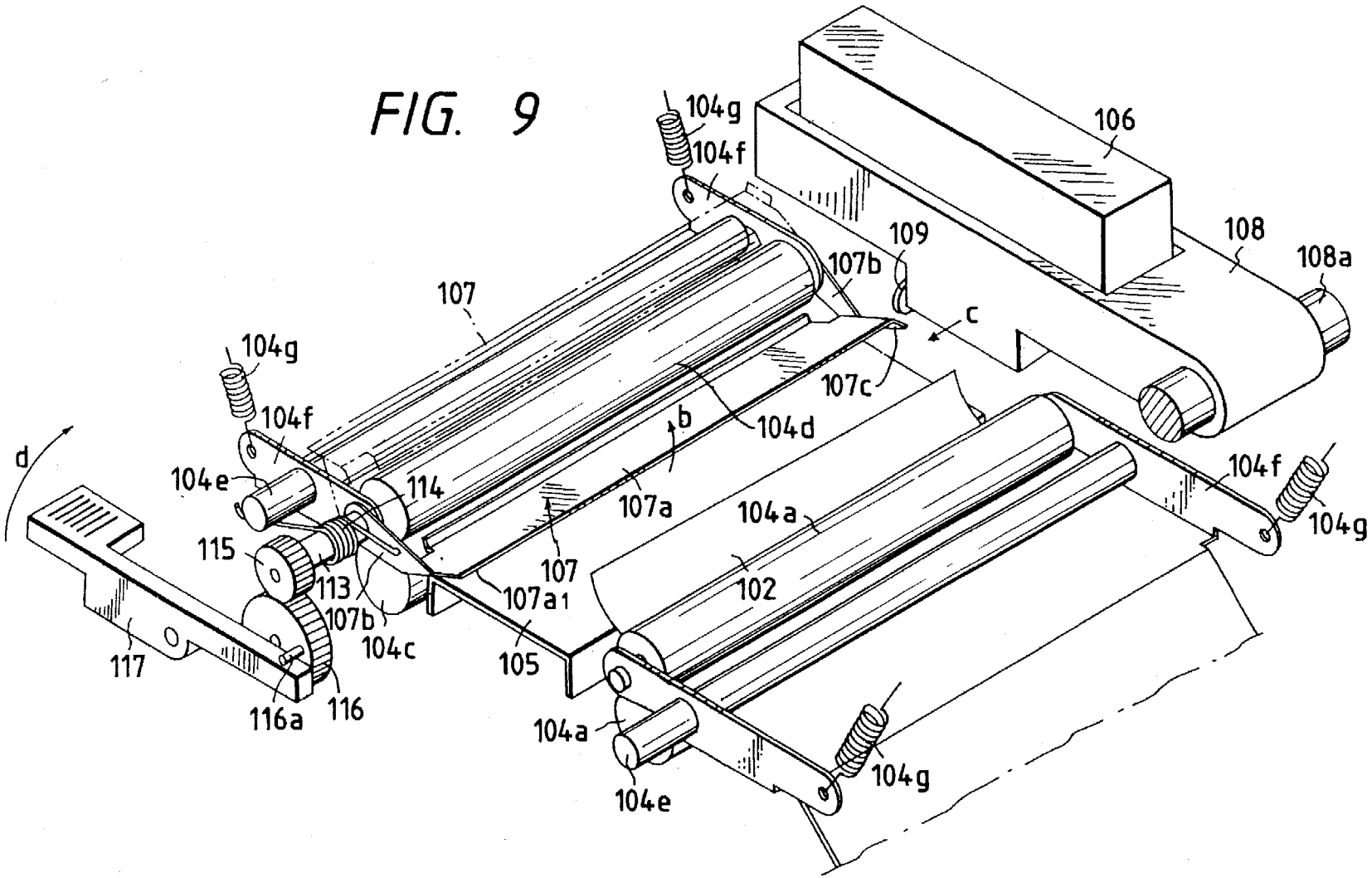
FIG. 9 is a perspective view of the ink jet recording apparatus of FIG. 8.

FIG. 8 is an elevational sectional view of a recording apparatus according to a third embodiment of the present invention, and FIG. 9 is a perspective view of such recording apparatus.

As shown in FIG. 8, the recording apparatus is so designed that an uppermost sheet 102 picked up and separated from a sheet stack resting in a cassette 101, by means of a pick-up roller 103 is fed by a sheet feeding means 104, and printing lines are recorded on the sheet 102 supported on a platen 105 by means of a recording head (recording means) 106 while floating of the sheet 102 is prevented by a sheet hold-down plate 107.

When a carriage 108 is shifted for the recording operation, the sheet hold-down plate 107 is urged against the recording sheet 102 by means of an urging member 109 attached to the carriage 108; whereas, when the carriage 108 returns to its home position, the sheet hold-down plate 107 is separated from the recording sheet 102.

Next, various elements will be fully described.

The sheet feeding means 104 comprises feed roller **104*a* and pinch roller 104*b* for feeding the recording sheet 102 to a recording area, and ejector roller 104*c* and pinch roller 104*d* for ejecting the recorded sheet onto an ejection tray 110. The feed roller 104*a* and the ejector roller 104*c* are connected to and driven by respective feed motors (not-shown), and the pinch rollers 104*b*, 104*d* are rotatably mounted on one end of each of corresponding levers 104*f* pivotally mounted on corresponding shafts 104*e* and are urged against the feed roller 104*a* and the ejector roller 104*c*, respectively, by means of corresponding tension springs 104*g* attached to the other ends of the levers 104*f*. Accordingly, when the feed motors are activated, the recording sheet 102 is shifted in a direction shown by the arrow a in FIG. 8**.

Incidentally, a driving force is transmitted to the ejector roller **104*c* via a slip clutch (not shown) so that a peripheral speed of the ejector roller becomes faster than that of the feed roller 104*a* by a few percent (%), thereby maintaining the proper tension in the recording sheet 102**.

Next, the carriage will be explained.

The carriage 108 is slidably and rotatably mounted on a main scan rail **108*a* shown in FIG. 9 and can be reciprocably shifted along the main scan rail 108*a* in directions transverse to the width of the recording sheet 102**.

A home position sensor is disposed at the home position of the carriage 108 to detect the fact that the carriage is in the home position. When the carriage is in the home position (FIG. 9), it is positioned away from the recording sheet 102.

Next, the sheet hold-down plate will be explained.

The sheet hold-down plate 107 serves to prevent of the recording sheet 102 from floating during the recording operation, and is arranged at a downstream side of a recording area P in the sheet feeding direction a. In the recording area P, each printing line is recorded on the recording sheet 102 by shifting the recording head 106. Arm portions **107*b* are integrally formed on both ends of an urging portion 107*a* of the sheet hold-down plate 107 having a length longer than the width of the recording sheet 102 by bending the material of the sheet hold-down plate. The arm portion 107*b* are secured to a roller shaft 113 of the pinch roller 104*d*. Further, a torsion coil spring 114 is mounted around one end of the roller shaft 113 so that the sheet hold-down plate 107 is always biased toward a direction shown by the arrow b in FIG. 9**.

Figure 10:
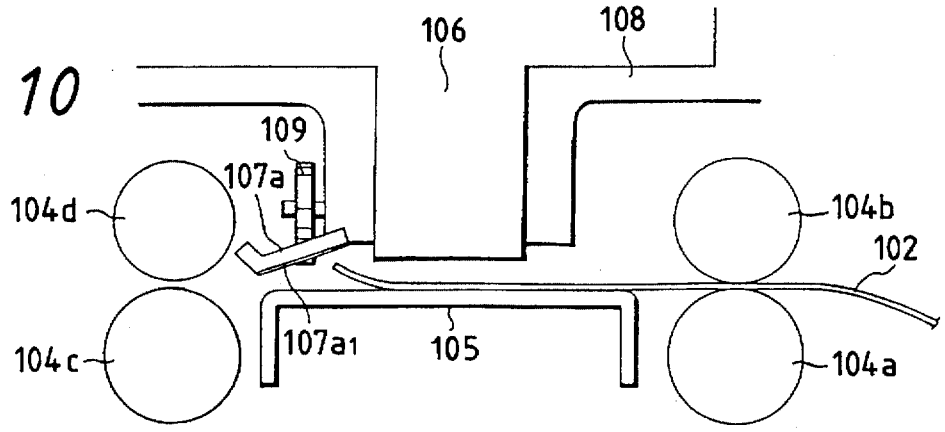
FIG. 10 is an elevational sectional view showing a condition that a sheet hold-down member is separated from a platen.

A gear 115 secured to the shaft 113 is meshed with a gear 116. A pin **116*a* protruding from an end surface of the gear 116 can be engaged by a lever 117 arranged at a side of the gear 116 so that the gear 115 and the sheet hold-down plate 107 are held at a predetermined position. In this predetermined position, as shown in FIG. 10, the urging portion 107*a* of the sheet hold-down plate is separated from the platen 105**.

Further, the urging portion **107*a* of the sheet hold-down plate is provided at one end with an inclined end portion 107*c* for facilitating the riding of an urging roller 109 (described later) rotatably mounted on the carriage 108 on the urging portion 107*a***.

Further, a surface of the urging portion **107*a* which contacts with the sheet 102 has a "water repelling feature" in order to prevent the non-dried ink including paper powder and the like from adhering to the urging portion 107*a***. The "water repelling feature" herein is a feature wherein an angle of contact regarding the pure water is greater than 90 degrees. The greater the angle of contact, the harder the non-dried ink is to adhere to the urging portion.

In the illustrated embodiment, the surface of the urging portion **107*a*** which contacts with the sheet has a water repelling layer $107a_1$ formed by coating the water repelling agent on that surface to provide the "water repelling feature". In consideration of a contacting feature with the ink, the water repelling agent may preferably be, for example, PFA (tetrafluoro ethylene-perfluoro alkyl vinyl ether copolymer), FEP (tetrafluoroethylene-hexafluoro propylene copolymer), PTFE (polytetrafluoro ethylene) and the like from the fluorine group, or may preferably be, for example, silicon resin and the like from the silicon group. Further, the coating of the water repelling agent may be performed by using a spray coating technique, brush coating technique, dipping technique, roll coating technique or the like.

Next, the urging member will be explained.

Figure 11:
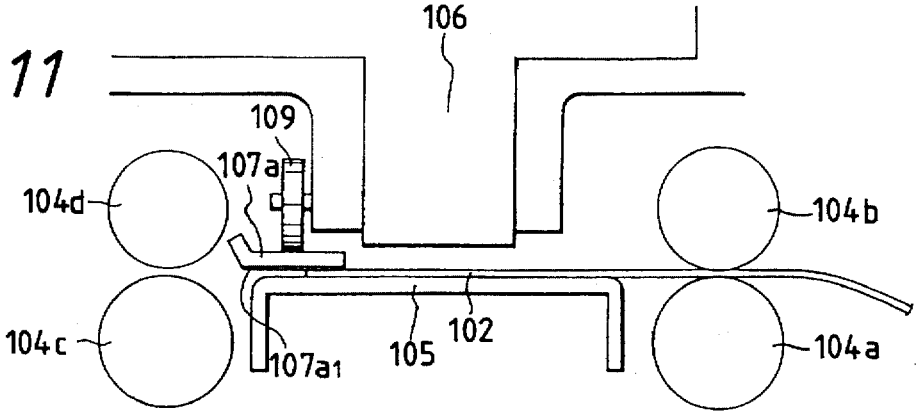
FIG. 11 is an elevational sectional view showing a condition that a recording sheet is urged against a platen by the sheet hold-down member.

The urging member serves to urge the urging portion 107*a* of the sheet hold-down plate against the platen 105. In the illustrated embodiment, the urging member comprises an urging roller 109 rotatably mounted on a lower surface of the carriage 108. When the carriage 108 is shifted in a direction shown by the arrow c in FIG. 9, the urging roller 109 rides on the urging portion 107*a* by the action of the weight of the carriage itself. As a result, the urging portion 107*a* of the sheet hold-down plate is rotated in opposition to the biasing force of the torsion coil spring 114, so that the sheet 102 is urged against the platen 105 by the urging portion 107*a*, as shown in FIG. 11. Thus, even if the recording sheet 102 is curled, a portion of the sheet 102 in the recording area is prevented from floating apart from the platen 105.

Incidentally, although a thickness of the recording sheet 102 to be fed may vary depending upon the kind of recording sheet, since the carriage 108 can be pivoted around the main scan rail 108*a* and can ride on the sheet hold-down plate 107, a distance between the recording sheet 102 and the recording head 106 is always maintained at a constant value, regardless of the thickness of the recording sheet 102.

With the arrangement as mentioned above, since the carriage 108 is in the home position during the feeding of the sheet, as shown in FIG. 10, the sheet hold-down plate 107 is separated from the platen 105. Consequently, even if the leading end of the recording sheet 102 is curled, it can be easily introduced below the urging portion 107*a* of the sheet hold-down plate. When the recording sheet 102 is fed up to the predetermined position, the carriage 108 which is waiting at the side of the platen 105 is now shifted along the main scan rail 108*a*, with the result that, as shown in FIG. 11, since the recording sheet 102 is urged against the platen 105 by the urging portion 107*a*, the leading end of the recording sheet 102 is prevented from floating apart from the platen even if the leading end of the recording sheet is not pinched by the ejector roller 104*c* and the pinch roller 104*d*, thus providing the proper printing condition of the sheet.

Further, when the recording sheet 102 is urged against the platen 105 by means of the urging portion 107*a*, since the sheet contacting surface of the urging portion has the water repelling feature, the paper powder and the like remaining on the recording sheet 102 does not adhere to the urging portion, and, even if the ink discharged on the sheet 102 is not completely dried, the ink does not adhere to the sheet hold-down plate 107. Thus, even when the sheet hold-down plate 107 contacts with the recording surface of the recording sheet 102, the sheet is not smeared with the ink.

Figure 12:
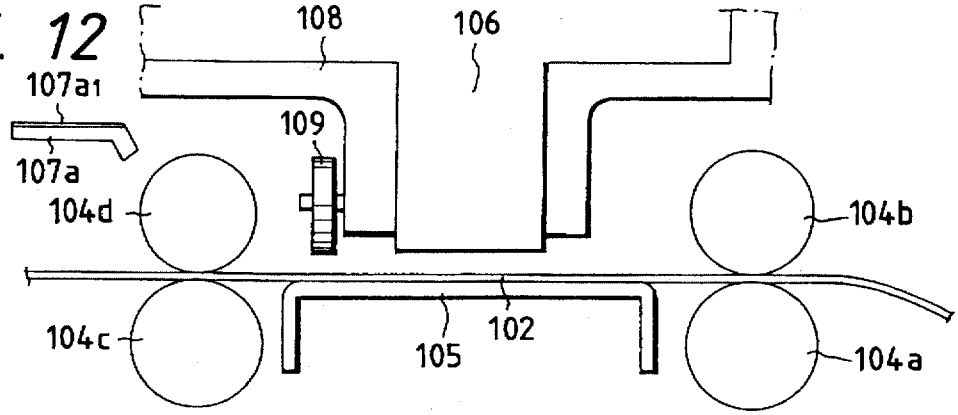
FIG. 12 is an elevational sectional view for explaining a condition that the recording is effected with respect to a recording sheet on which ink is dried slowly.

Incidentally, a sheet such as a plastic sheet (OHP sheet) on which the ink is hard to be dried is used as the recording sheet 102, the lever 117 is rotated in a direction shown by the arrow d in FIG. 9, with the result that the sheet hold-down plate 107 is retarded to a position shown by a phantom line in FIG. 9 (i.e., a position where the sheet hold-down plate does not interfere with the shifting movement of the carriage 108) by the spring force of the torsion coil spring 114. Thus, since the recorded sheet 102 does not contact with the sheet hold-down plate 107 as shown in FIG. 12, the sheet and the sheet hold-down plate are not smeared with the ink.

Next, a fourth embodiment of the present invention will be explained. Incidentally, constructural elements the same as those in the aforementioned third embodiment are designated by the same reference numerals, and the explanation thereof will be omitted.

While the sheet hold-down plate 107 was arranged only at the downstream side of the recording area in the third embodiment, in this fourth embodiment, an additional sheet hold-down plate may be disposed at an upstream side of the recording area.

Figure 13:
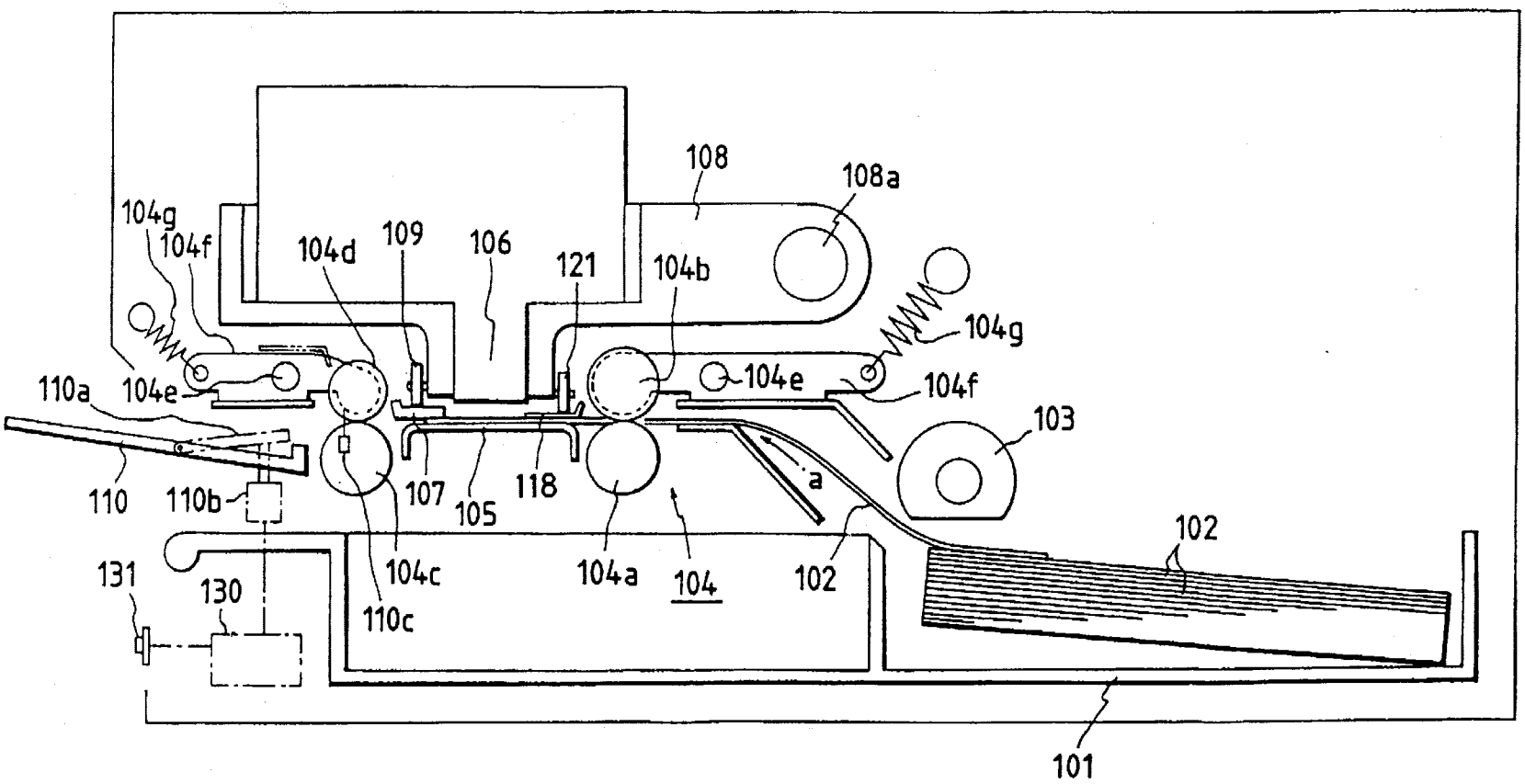
FIG. 13 is an elevational sectional view of an ink jet recording apparatus according to a fourth embodiment of the present invention.
Figure 14:
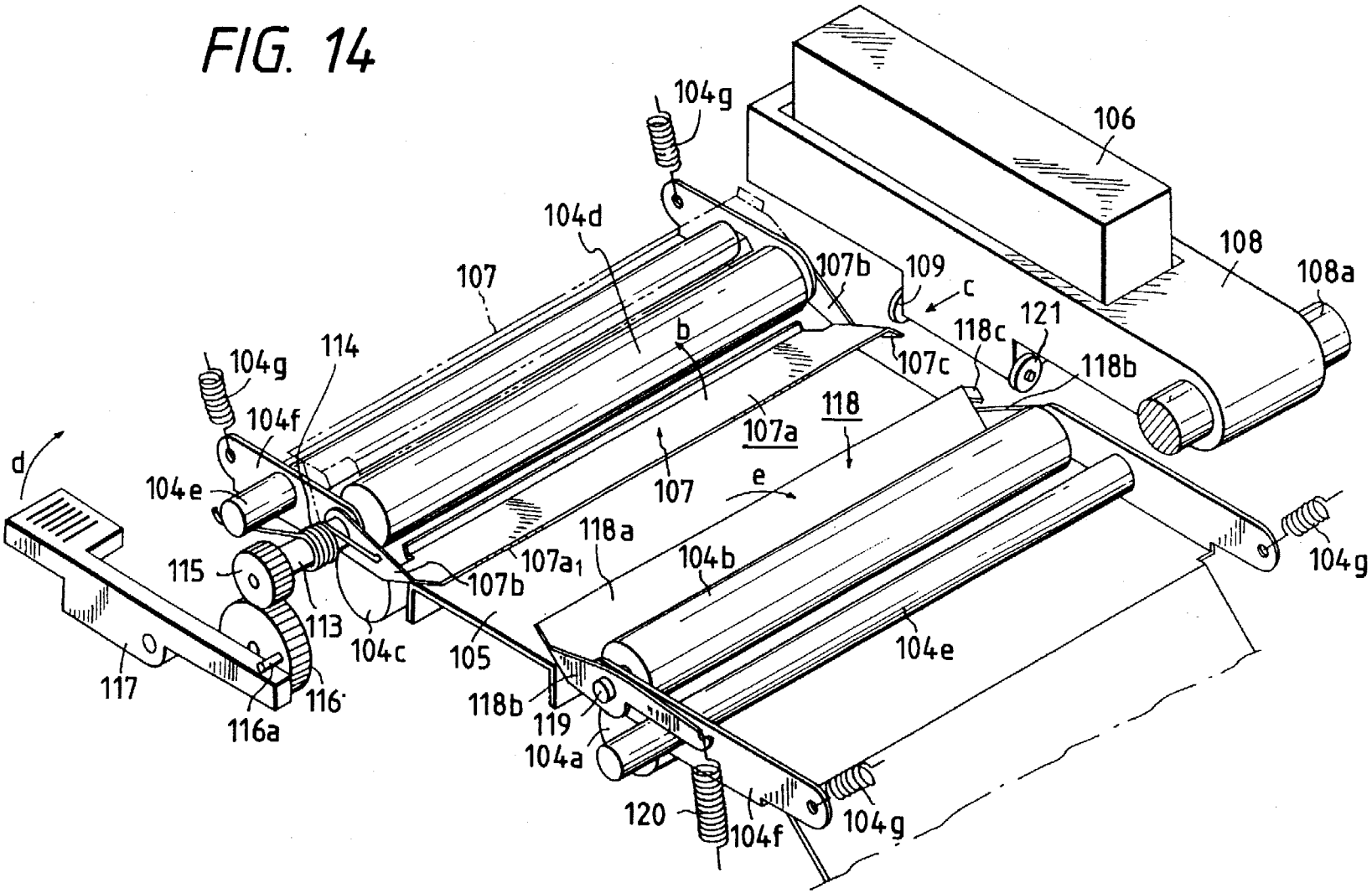
FIG. 14 is a perspective view of the ink jet recording apparatus of FIG. 13.
Figure 15:
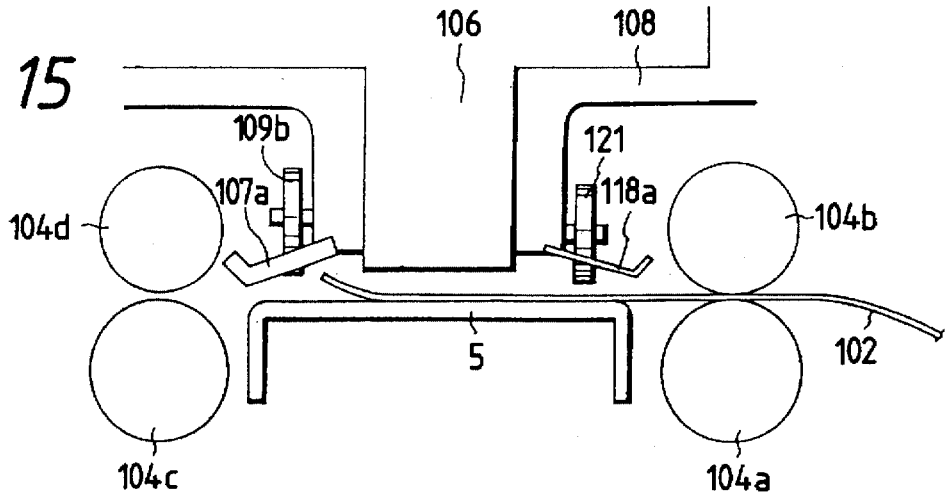
FIGS. 15 to 19 are elevational sectional views for explaining the operation of a sheet hold-down member.

For example, as shown in FIGS. 13 and 14, in addition to the aforementioned sheet hold-down plate 107, an additional sheet hold-down plate 118 is disposed at the upstream side of the sheet hold-down plate 107 in the sheet feeding direction. The upstream sheet hold-down plate 118 is provided with arm portion 118*b* integrally formed on both ends of an urging portion 118*a* of the sheet hold-down plate 118 having a length longer than the width of the recording sheet 102 by bending the material of the sheet hold-down plate. The arm portion 118*b* are rotatably supported by a roller shaft 119 of the pinch roller 104*b*. Further, a tension spring 120 attached to one end of one of the arm portion 118*b* biases the urging portion 118*a* of the sheet hold-down plate toward a direction shown by the arrow e in FIG. 14, so that the arm portions 118*b* are abutted against a shaft 104*e* acting as a stopper. Incidentally, in a condition that the arm portions 118*b* are abutted against the shaft 104*e*, the urging portion 118*a* is separated from the platen 105 (FIG. 15).

Further, the urging portion 118*a* of the sheet hold-down plate is provided at its one end with an inclined end portion 118*c* for facilitating the riding of an upstream urging roller 121 acting as an urging member rotatably mounted on the carriage 108 on the urging portion 118*a*.

With the arrangement as mentioned above, when the carriage 108 is shifted for the recording operation, the urging rollers 109, 121 urge the sheet hold-down plates 107, 118 downwardly, respectively, with the result that the recording sheet 102 is urged against the platen 105 by means of the sheet hold-down plates 107, 118, respectively, at downstream and upstream sides of the recording area. Accordingly, if a trailing end of the recording sheet is curled, even when the trailing end of the recording sheet leaves the feed roller 104*a* and pinch roller 104*b*, floating of the trailing end of the recording sheet can effectively be prevented, thus providing the stable recording condition of the sheet.

Figure 16:
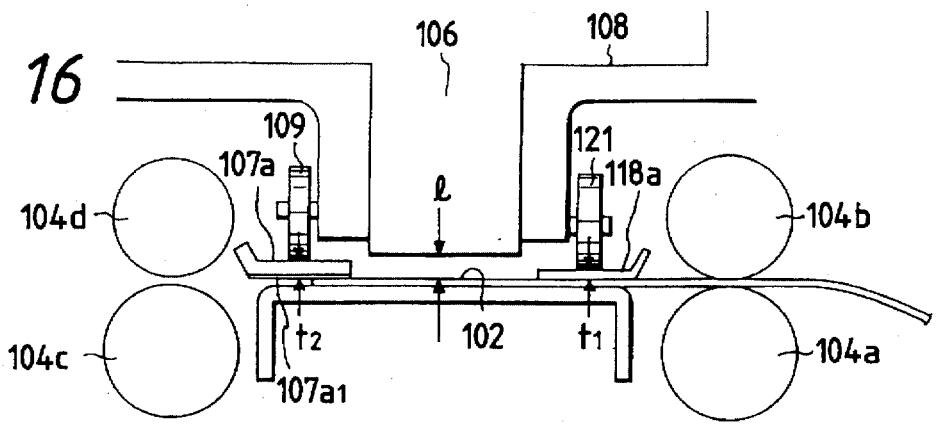

Incidentally, when the sheet hold-down plates 107, 118 are provided, as shown in FIG. 16, a thickness $t_1$ of the upstream sheet urging portion 118*a* is selected so as to be thinner than a thickness $t_2$ of the downstream sheet urging portion 107*a* ($t_1<t_2$), and a distance between the platen 105 and the upstream urging roller 121 is preferably selected to be shorter than a distance between the platen and the downstream urging roller 109.

For example, the thickness $t_1$ of the upstream sheet urging portion 118*a* was 0.25 mm and the thickness $t_2$ of the downstream sheet urging portion 107*a* was 0.5 mm. Further, in the condition that the recording sheet 102 is urged against the platen by means of the sheet urging portions 118*a*, 107*a* as shown in FIG. 16, a distance l between the recording sheet 102 and the recording head 106 was set to have a value of 0.7 mm.

Figure 17:
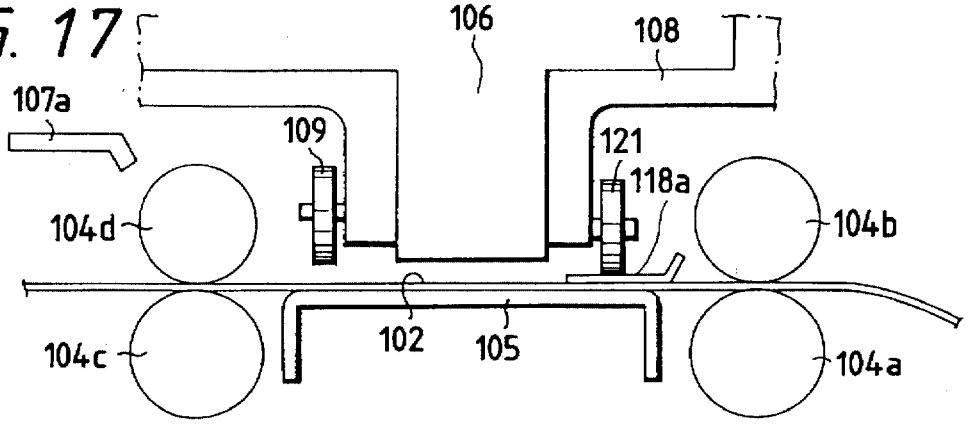

With this arrangement, when the downstream sheet hold-down plate 107 is retarded to the position shown in FIG. 17 by manipulating the lever 117, the recording sheet 102 can surely be prevented from contacting the downstream urging roller 109.

Figure 18:
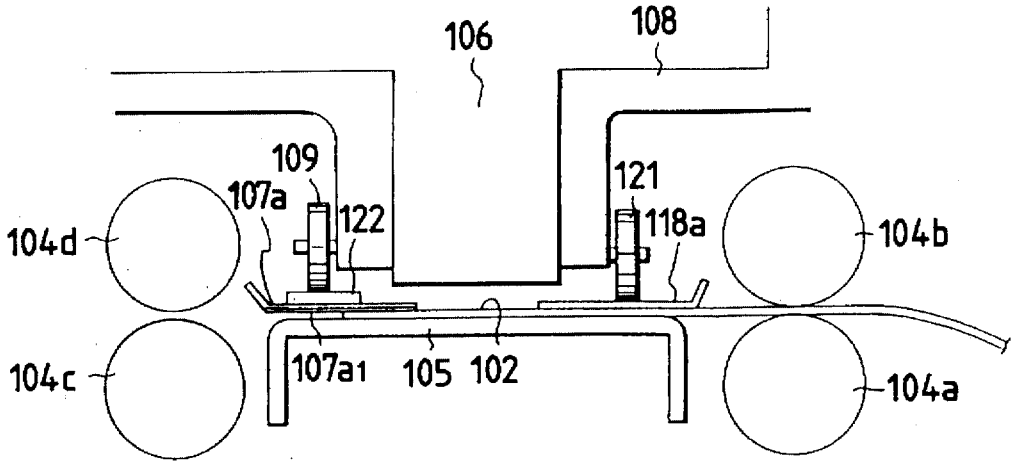

Incidentally, when the distance between the downstream urging roller 109 and the platen 105 is longer than the distance between the upstream urging roller 121 and the platen as mentioned above, in order to compensate for the difference in such distances, in place of the above-mentioned construction, as shown in FIG. 18, the thickness of the downstream sheet urging portion 107*a* may be the same as that of the upward sheet urging portion 118*a* and a spacer sheet 122 may be adhered to an upper surface of the downstream sheet urging portion 107*a* to compensate for such difference.

Figure 19:
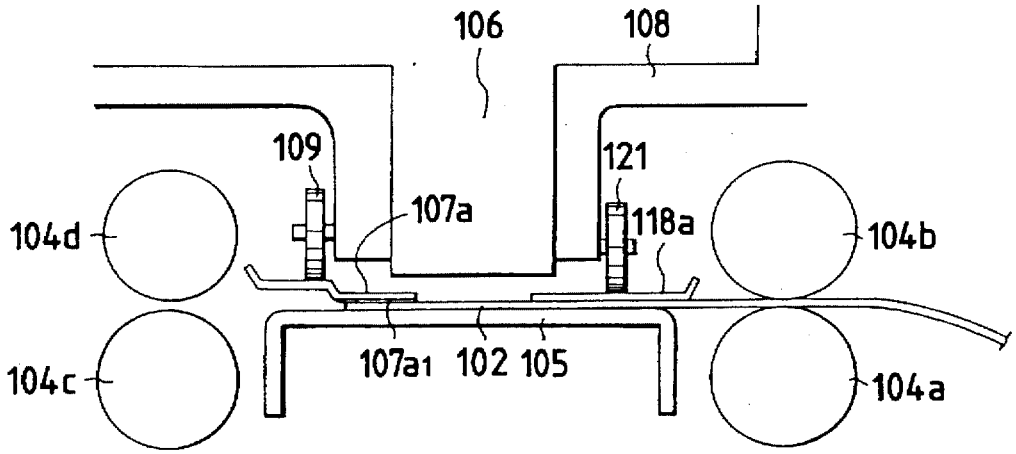

Alternatively, in place of the spacer sheet 122, as shown in FIG. 19, the downstream sheet hold-down plate 107 may be formed to have a stepped configuration so that the difference between the longer distance (between the downstream urging roller 109 and the platen 105) and the shorter distance (between the upstream urging roller 121 and the platen) can be compensated.

Further, in the illustrated embodiment, while the sheet hold-down plates could be pivoted, they may be translated in up-and-down directions. In addition, while the sheet hold-down plates were urged or shifted by the movement of the carriage 108, they may be connected to respective plungers so that they can be urged against the platen by activating the plungers on the basis of a signal from a control portion.

Further, in all of the illustrated embodiments, a bubble jet recording system can be used as the recording means.

Next, the recording means capable of being used with each embodiment of the present invention will be described.

The recording means serves to form an ink image on the recording sheet fed by the feeding means. In one embodiment, the recording means utilizes an ink jet recording system.

The ink jet recording system includes liquid discharge openings for discharging recording ink as flying liquid droplets, liquid passages communicated with the discharge openings, and discharge energy generating means provided at portions of the liquid passages and adapted to generate discharge energy for flying the ink liquid in the liquid passages. By activating the selected energy generating means in response to a drive signal, the ink droplets are discharged from the discharge openings to form an image on a recording sheet.

The discharge energy generating means may be, for example, a pressure energy generating means using electrical/mechanical converter elements such as piezo electric elements, an electromagnetic energy generating means for discharging the ink by applying the electromagnetic wave such as laser to the ink liquid so as to heat the ink liquid, or a thermal energy generating means for discharging the ink liquid by heating the ink liquid by means of electrical/thermal converter elements. Among them, the thermal energy generating means using electrical/thermal converter elements is most preferable since the discharge openings can be arranged with high density to perform the recording with high resolving power and the recording head can be compacted.

In the illustrated embodiment, a bubble jet recording means which is one kind of the ink jet recording means is used as the recording means.

Figure 20:
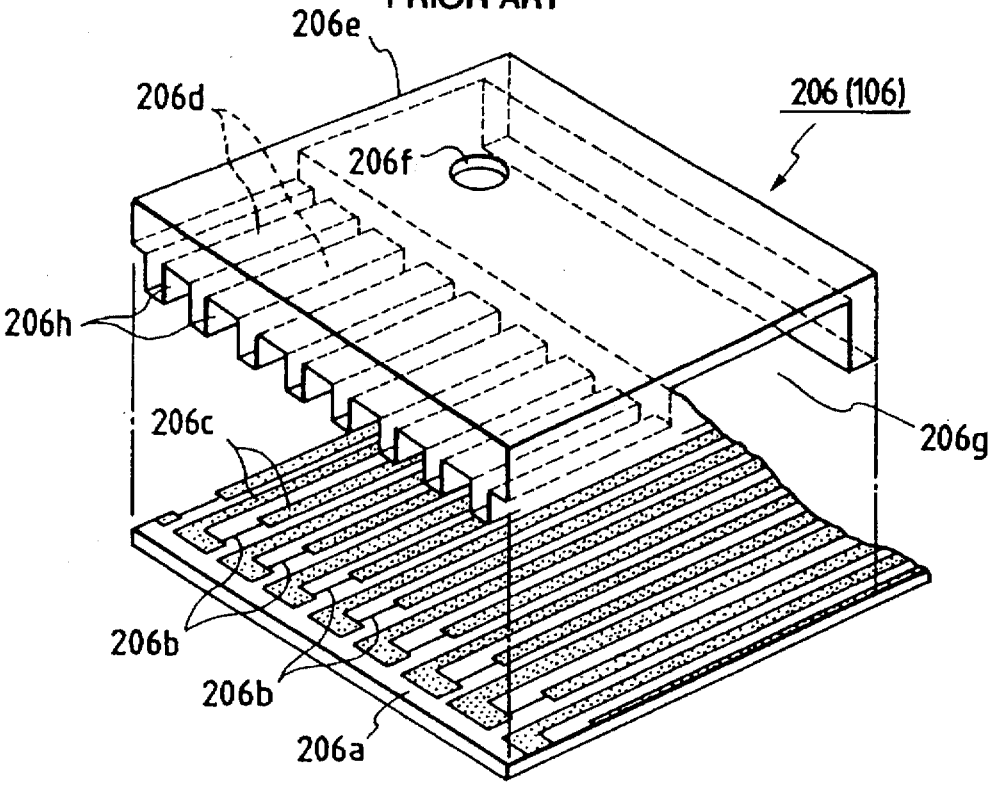
FIG. 20 PRIOR ART
FIG. 20 is an exploded perspective view of a recording head.
Figure 22:
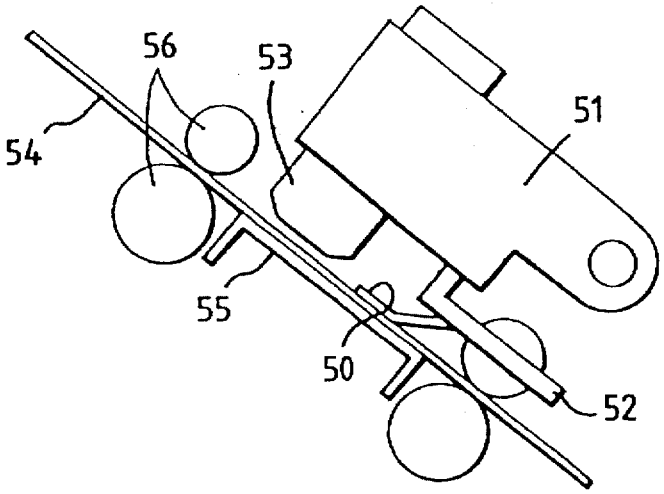
FIG. 22 PRIOR ART
FIG. 22 is a sectional view of a conventional sheet hold-down mechanism.

FIG. 20 shows an exploded perspective view of the recording head 206 (106) constituting the recording means, and FIGS. 21A to 21G show a principle of the bubble jet recording process.

In FIG. 20, the reference numeral 206*a* denotes a heater board wherein electrical/thermal converters (discharge heaters) 206*b* and electrodes 206*c* made of aluminum which supply electric power to the electrical/thermal converters are formed on a silicon substrate by a film forming process. A top plate 206*e* having partition walls for defining recording liquid passages (nozzles) 206*d* is adhered to the heater board 206*a*. Further, an ink cartridge (not shown) for supplying the ink to the recording head is removably mounted on the head in place.

The ink supplied from the ink cartridge to the recording head via a conduit is directed to a common liquid chamber 206*g* in the head through a supply opening 206*f* formed on the top plate 206*e* and then is sent to the nozzles 206*d* from the common liquid chamber 206*g*. The nozzles 206*d* have ink discharge openings 206*h*, respectively, which are disposed at a predetermined pitch along a sheet feeding direction in downward confronting relation to the sheet.

In the illustrated embodiment, the recording head 206 (106) is mounted on a reciprocable carriage and the recording is performed by discharging the ink from the recording head 206 (106) synchronously with the shifting movement of the carriage.

Preferably, a principle for forming the flying ink droplet in the bubble jet recording system can be realized by using the fundamental principles, for example, disclosed in U.S. Pat. Nos. 4,723,129 and 4,740,796. Although this system can be applied to both a so-called "on-demand type" and "continuous type", it is more effective when the system is particularly applied to the on-demand type, because, by applying at least one drive signal corresponding to the record information and capable of providing the abrupt temperature increase exceeding the nucleate boiling to the electrical/thermal converting elements arranged in correspondence to the sheet or liquid passages including the liquid (ink) therein, it is possible to form a bubble in the ink corresponding to the drive signal by generating the film boiling on the heat acting surface of the recording head due to the generation of the thermal energy in the electrical/thermal converting elements. Due to the growth and contraction of the bubble, the ink is discharged from the discharge opening to form at least one ink droplet. When the drive signal has a pulse shape, since the growth and contraction of the bubble can be quickly effected, excellent ink discharge is achieved.

Now, the principle for forming the flying droplet in the bubble jet recording process will be briefly explained with reference to FIGS. 21A to 21G.

Figure 21A:
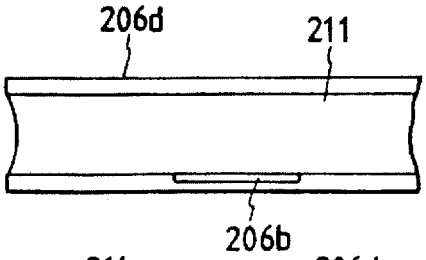
FIG. 21A PRIOR ART
FIGS. 21A to 21G are explanatory views for explaining a bubble jet recording principle.
Figure 21B:
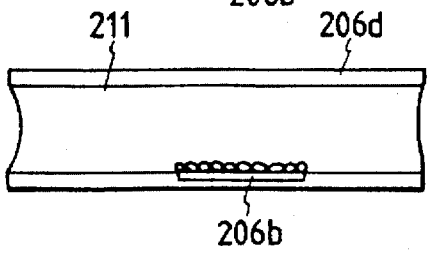
FIG. 21B PRIOR ART
Figure 21C:
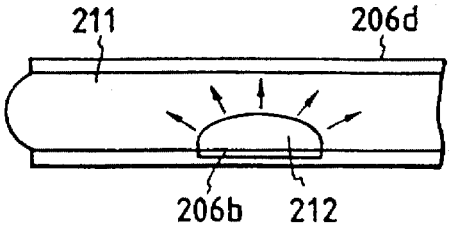
FIG. 21C PRIOR ART

In the steady-state, as shown in FIG. 21A, a tension force of the ink 211 filled in the nozzle 206*d* is equilibrated with the external force at an discharge opening surface. In this condition, when the ink 211 is desired to fly, the electrical/thermal converter 206*b* disposed in the nozzle 206*d* is energized to abruptly increase the temperature of the ink in the nozzle 206*d* exceeding the nucleate boiling. Consequently, as shown in FIG. 21B, the ink portion adjacent to the electrical/thermal converter 206*b* is heated to create a fine bubble, and then the heated ink portion is vaporized to generate the film boiling, thus growing the bubble 212 quickly, as shown in FIG. 21C.

Figure 21D:
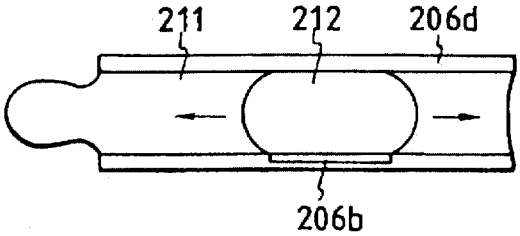
FIG. 21D PRIOR ART
Figure 21E:
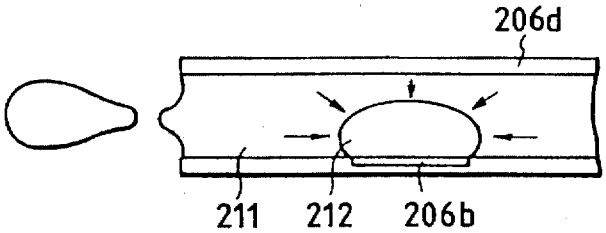
FIG. 21E PRIOR ART
Figure 21F:
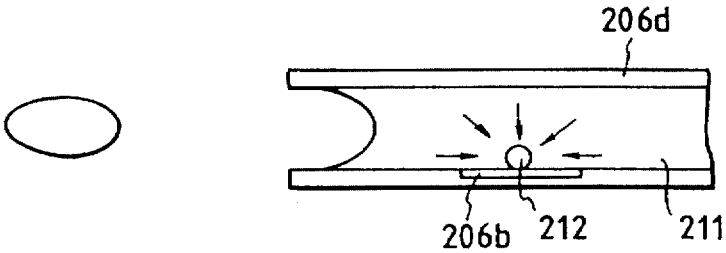
FIG. 21F PRIOR ART
Figure 21G:
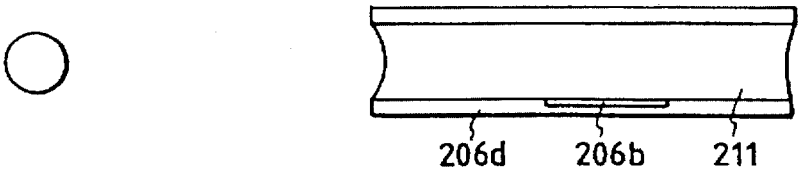
FIG. 21G PRIOR ART

When the bubble 212 is grown at the maximum extent as shown in FIG. 21D, the ink droplet is pushed out of the discharge opening of the nozzle 206*d*. When the electrical/thermal converter 206*b* is disenergized, as shown in FIG. 21E, the grown bubble 212 is cooled by the ink 211 in the nozzle 206*d* to contract. Thus, due to the growth and contraction of the bubble, the ink droplet flies from the discharge opening. Further, as shown in FIG. 21F, the ink contacted with the surface of the electrical/thermal converter 206*b* is quickly cooled, thus diminishing the bubble 212 or reducing the volume of the bubble to a negligible extent. When the bubble 212 is diminished, as shown in FIG. 21G, the ink is replenished in the nozzle 206*d* from the common liquid chamber 206*g* by a capillary phenomenon, thus preparing the next formation of the ink droplet.

Accordingly, by reciprocally shifting the carriage and by selectively energizing the electrical/thermal converters 206*b* in response to the pulse drive signal, the ink image can be recorded on the sheet. Preferably, the pulse drive signal may be as disclosed in U.S. Pat. Nos. 4,463,359 and 4,354,262. Further, when the condition discussed in the U.S. Pat. No. 4,313,124 relating to the invention regarding the increasing rate of the temperature of the heat acting surface, improved recording can be achieved.

Incidentally, in the above-mentioned recording system, it is preferable that a recovery means and an auxiliary aiding means are provided at the home position of the carriage. More particularly, these means include a capping means for capping the recording head, cleaning means, pressurizing or suction means, auxiliary heating means comprising electrical/thermal converters 206*b* or other heating elements or the combination thereof, and a preliminary discharge mode means for discharging the ink independently of the recording operation.

As the construction of the recording head, the present invention includes the construction wherein the head acting portion is disposed in an arcuate area as disclosed in U.S. Pat. Nos. 4,558,333 and 4,459,600, as well as the aforementioned constructions wherein the discharge openings, liquid paths and electrical/thermal converting elements are combined (straight liquid paths or orthogonal liquid paths). In addition, the present invention can be applicable to the construction wherein each discharge opening is constituted by a slit with which a plurality of electrical/thermal converting elements associated in common as disclosed in the Japanese Patent Laid-Open No. 59-123670 or the construction wherein openings for absorbing the pressure wave of the thermal energy are arranged in correspondence to the discharge openings as disclosed in the Japanese Patent Laid-Open No. 59-138461, because the recording can be correctly and effectively performed by the bubble jet recording system, regardless of the configuration of the recording head.

Further, the present invention can be applied to a recording head of a full-line type having a length corresponding to a maximum width of a recording medium to be recorded, as such a recording head, the construction wherein such length is attained by combining a plurality of recording heads or a single recording head integrally formed may be adopted.

In addition, among the above-mentioned serial types, the present invention is effectively applicable to a removable recording head of chip type wherein, when mounted on the recording system, an electrical connection between it and the recording system and the supply of ink from the recording system can be permitted, or to a recording head of a cartridge type wherein a cartridge is integrally formed with the head.

Further, as to the kind and number of the recording heads to be mounted, each recording head may correspond to each different color ink, or a plurality of recording heads can be used for a plurality of ink having different colors and/or different density. Further, as the recording mode of the recording system, the present invention can effectively be applied not only to a recording mode with a single main color such as black, but also to a system providing a plurality of different colors and/or full-color by mixing colors by using an integrated recording head or the combination of plural recording heads.

Further, in the illustrated embodiments, while the ink was liquid, the ink may be solid in a room temperature or less, or may be softened at a room temperature. In the above-mentioned ink jet recording system, since the temperature control is generally effected in a temperature range from 30° C. to 70° C. so that the viscosity of the ink is maintained within a stable discharging range, the ink may be liquidized when the record signal is omitted. In addition, ink having a feature that is firstly liquidized by the thermal energy, such as solid ink which serves to prevent the increase in temperature by absorbing energy in charging the ink from the solid state to the liquid state or which is in the solid state in the preserved condition to prevent the vaporization of ink and which is liquidized into ink liquid to be discharged in response to the record signal comprising the thermal energy, or ink which has already been solidified upon reaching the recording medium, can also be applied to the present invention. In such a case, the ink can be held in the liquid state or solid state in recesses or holes in porous sheet as disclosed in the Japanese Patent Laid-Open Nos. 54-56847 and 60-71260, in a confronting relation to the electrical/thermal converters. Incidentally, in the bubble jet recording, the above-mentioned film boiling principle is most effective for each ink.

Further, in the illustrated embodiments, while the ink jet recording system was explained as the recording means, other recording means such as a wire dot recording system and the like may be used as the recording means.

In addition, the feeding means for the recording sheet is not limited to the rollers as in the illustrated embodiments, but, for example, the feeding force may be applied to the recording sheet 102 by means of a rotatable belt and the like.

Incidentally, the recording apparatus can be in the form of a copying machine in combination with reader or a facsimile system having the communication function, as well as an image terminal equipment for an information treating device such as a computer and the like.

As mentioned above, since the leading end of the recording sheet is urged against the platen by means of the sheet hold-down plate during the recording operation, it is possible to prevent the floating of the recording sheet and to minimize the blank portion remaining at the leading portion of the recording sheet, thus providing the excellent recording efficiency.

Further, since the sheet contacting surface of the sheet hold-down plate has the water repelling feature, it is hard to adhere the ink and the like to the sheet hold-down plate, thus effectively preventing the recording sheet from being smeared with the ink. Particularly, this is true when a sheet (for example, OHP sheet) on which the ink is hard to be dried is used.

In the illustrated embodiments, the recording sheet can be manually supplied one by one. Such manual sheet supply will be explained in connection with the above-mentioned fourth embodiment, for example.

In FIG. 13, the reference numeral 131 denotes a switch for changing to a manual sheet supply mode; and 130 denotes a control circuit. When the manual sheet supply mode is established by the switch 131, a manual sheet supply guide 110*a* is shifted, by means of a plunger 110*b*, from a position where it is aligned with the ejection tray 110 to a position shown by the phantom line in FIG. 13. In this condition, when the recording sheet is rested on the ejection tray 110 and then is slid toward the ejector roller 104*c*, the leading end of the recording sheet is directed, by the manual sheet supply guide 110*a*, to the nip between ejector roller 104*c* and the pinch roller 104*d*. When the recording sheet reaches the nip, the leading end of the recording sheet is detected by a sensor 110*c*, with the result that, in response to a detection signal from the sensor, the control circuit 130 activates the motor to rotate the feed roller 104*a* and the ejector roller 104*c* in a clockwise (reverse) direction.

The recording sheet is conveyed on the platen 105 while being pinched by the ejector roller 104*c* and the pinch roller 104*d*. In this point, since the carriage 108 is in the home position, as shown in FIG. 15, the downstream and upstream sheet hold-down plates 107, 118 are separated from the platen 105, thus not blocking the movement of the recording sheet. Then, the leading end of the sheet is pinched by the feed roller 104*a* and the pinch roller 104*b* and is fed between the pick-up roller 103 and the uppermost sheet in the cassette 101.

When the trailing end of the recording sheet reaches a predetermined position between the ejector roller 104*c* and the feed roller 104*a*, the recording sheet is stopped temporarily. The predetermined position may be a position shown in FIG. 15 or may be any position at the upstream side of the position of FIG. 15 so long as the recording sheet is pinched by the feed roller 104*a* and the pinch roller 104*b*. In order to stop the recording sheet at the predetermined position, the control circuit 130 counts the time or the pulse numbers of the motor for driving the roller 104*c* immediately after the trailing end of the recording sheet has just passed through the roller 104*c*, and stops the roller when predetermined pulse numbers are counted.

Then, the feed roller 104*a* is rotated in an anti-clockwise (normal) direction by a predetermined number of pulses in order to feed the recording sheet up to the position of FIG. 15. If the recording sheet is firstly stopped at this position, the normal rotation of the feed roller is not needed. Thereafter, the recording operation is performed in the same manner as in the case where the recording sheet is supplied from the cassette 101 as mentioned above. After the recording is finished, the recording sheet is ejected on the ejection tray 110.

In the above-mentioned embodiments, the platen 105 supports the recording sheet at the recording area by contacting the back surface (opposite to the recording head) of the recording sheet. However, alternatively, the platen may be so designed that it supports the recording sheet by contacting the back surface of the recording sheet only at the downstream side or at both upstream and downstream sides of the recording area without contacting the back surface of the sheet at the recording area (i.e., the platen may be cut off at the recording area P shown in FIG. 8).

What is claimed is:

1. A recording apparatus, comprising:

a guide for supporting a sheet at a recording area thereof;

a feeding rotary member for feeding the sheet to said guide;

a recording head for recording an image on the sheet at the recording area by adhering an ink to the sheet; and an urging plate for urging the sheet against said guide, said urging plate having a water repellant surface abutted to the sheet and being disposed downstream of the recording area, and said urging plate assuming one of a first mode to urge the sheet against said guide while said recording head is adhering the ink to the sheet and a second mode not urging the sheet against said guide means while said recording head is adhering the ink to the sheet.

2. A recording apparatus according to claim 1, further including shifting means for shifting said urging plate between an urging position where the sheet is urged against said guide and a non-urging position where the sheet is not urged against said guide.

3. A recording apparatus according to claim 2, further including operation means for activating said shifting means.

4. A recording apparatus according to claim 2, further including control means for controlling said shifting means to position said urging plate either at the urging position or at the non-urging position during the recording operation.

5. A recording apparatus according to claim 4, further including a switch, and wherein said control means controls said shifting means in accordance with an operation of said switch.

6. A recording apparatus according to claim 4, further including detection means for detecting a type of material of the sheet to be fed, and wherein said control means controls said shifting means in accordance with a detection signal from said detection means.

7. A recording apparatus according to claim 1, wherein said feeding rotary member is stopped when the sheet is fed by a predetermined distance, said recording head records the image on the sheet being stopped, and said urging plate is positioned at an urging position where the sheet is urged against said guide during the recording operation and is positioned at a non-urging position where the sheet is not urged against said guide during the feeding of the sheet.

8. A recording apparatus according to claim 1, wherein said recording read record the image while shifting in a direction transverse to a width of the sheet when the sheet is fed by a predetermined distance, and said urging plate is shifted, synchronously with the shifting of said recording read, from a non-urging position where the sheet is not urged against said guide to an urging position where the sheet is urged against said guide.

9. A recording apparatus according to claim 8, further including contacting means movable integrally with said recording head for shifting said urging plate to the urging position by contacting said urging plate.

10. A recording apparatus according to claim 9, wherein said contacting means comprises a rotary body contacting said urging plate while rolling.

11. A recording apparatus according to claim 1, further including control means for stopping said feeding rotary member after said feeding rotary member feeds the sheet to a predetermined position where a leading end of the sheet can be urged by said urging plate, and for controlling said urging plate to urge the leading end of the sheet.

12. A recording apparatus according to claim 1, wherein said guide contacts the sheet downstream of the recording area.

13. A recording apparatus according to claim 12, wherein said guide does not contact the sheet at the recording area.

14. A recording apparatus according to claim 1, wherein said recording head comprises an ink jet head for discharging ink.

15. A recording apparatus according to claim 14, wherein said ink jet head records the image on the sheet with the ink discharged by thermal energy.

16. A recording apparatus according to claim 1, further including a second urging plate for urging the sheet against said guide between said feeding means and the recording area.

17. A recording apparatus according to claim 16, wherein said recording head records the image while shifting in a direction transverse to a width of the sheet when the sheet is fed by a predetermined distance, and said first and second urging plates are shifted, synchronously with the shifting of said recording head, from a non-urging position where the sheet is not urged against said guide to an urging position where the sheet is urged against said guide.

18. A recording apparatus according to claim 17, further including contacting means, movable integrally with said recording head for shifting said first and second urging plate to the urging position by contacting said first and second urging plate.

19. A recording apparatus according to claim 18, wherein said contacting means comprises first and second rotary bodies contacting said first and second urging plates respectively, while rolling.

20. A recording apparatus according to claim 19, wherein a first thickness of said first urging plate in a direction substantially perpendicular to said guide is more than a second thickness of said second urging plate in the direction substantially perpendicular to said guide.

21. A recording apparatus, comprising:

a platen for holding a sheet at a recording area thereof;

first feeding means disposed upstream of said guide for feeding the sheet to said platen;

recording means for recording an image on the sheet at the recording area by adhering an ink to the sheet;

second feeding means disposed downstream of said platen for feeding the sheet on which the image is recorded by said recording means;

a first urging plate disposed between the recording area and said first feeding means for urging the sheet against said platen; and a second urging plate disposed between the recording area and said second feeding means for urging the sheet against said platen;

mode switching means for switching modes of said first urging plate and said second urging plate between a first mode and a second mode;

wherein said first and second urging plates assume one of the first mode to urge the sheet against said platen while said recording head is adhering the ink to the sheet and the second mode not urging the sheet against said platen while said recording head is adhering the ink to the sheet.

22. A recording apparatus according to claim 21, further including shifting means for shifting said second urging plate between an urging position where the sheet is urged against said platen and a non-urging position where the sheet is not urged against said platen.

23. A recording apparatus according to claim 22, further including operation means for activating said shifting means.

24. A recording apparatus according to claim 21, further including control means for controlling said shifting means to position said second urging plate either at an urging position or at a non-urging position during a recording operation.

25. A recording apparatus according to claim 24, further including a switch, and wherein said control means controls said shifting means in accordance with an operation of said switch.

26. A recording apparatus according to claim 24, further including detection means for detecting a type of material of the sheet to be fed, and wherein said control means controls said shifting means in accordance with a detection signal from said detection means.

27. A recording apparatus according to claim 21, wherein said recording means records the image while shifting in a direction transverse to a width of the sheet when the sheet is fed by a predetermined distance, and, synchronously with the shifting of said recording means, said shifting means shifts said first urging plate and said second urging plate to an urging position where the sheet is urged against said platen.

28. A recording apparatus according to claim 21, wherein said recording means comprises an ink jet head for discharging ink.

29. A recording apparatus according to claim 21, wherein said ink jet head records the image on the sheet with the ink discharged, by thermal energy.

30. A recording apparatus according to claim 21, wherein said second urging plate comprises a surface capable of contacting the sheet, said surface comprises a water repelling feature.

31. A recording apparatus according to claim 21, further including abutment means, movable integrally with said recording means, for shifting said first and second urging plates to an urging position by contacting said first and second urging plates.

32. A recording apparatus according to claim 31, wherein said abutment means comprises first and second rotary bodies contacting said first and second urging plates, respectfully, while rolling.

33. A recording apparatus according to claim 21, further including guide means disposed downstream of said second feeding means and for guiding the sheet to said second feeding means from downstream of said second feeding means; and control means for controlling said second feeding means to feed the sheet guided by said guide means to the recording area and to feed the sheet downstream.

34. A recording apparatus according to claim 33, wherein said control means controls said first feeding means to feed the sheet guided by said guide means and fed upstream to the recording area by said second feeding means.

35. A recording apparatus according to claim 34, wherein said control means controls said first feeding means and said recording means to feed the sheet fed upstream by said first feeding means to the recording area by feeding the sheet downstream and to record the image, by said recording means, on the sheet fed to the recording area.

36. A recording apparatus, comprising:

a platen for supporting a sheet at a recording area thereof;

feeding means for feeding the sheet to said platen;

recording means for recording an image on the sheet at the recording area by adhering an ink to the sheet;

an urging plate for urging the sheet against said platen;

shifting means for shifting said urging member so that it depresses the sheet as long as said recording head adheres the ink to the sheet and releases the depression during sheet feeding by said feeding means; and prohibiting means for prohibiting the depression by said urging member according to the kind of sheet, even while said recording means is adhering the ink to the sheet.

37. A recording apparatus according to claim 36, further including operation means for activating said shifting means.

38. A recording apparatus according to claim 36, further including control means for controlling said shifting means to position said urging member either at the urging position or at the non-urging position during a recording operation.

39. A recording apparatus according to claim 38, further including a switch, and wherein said control means controls said shifting means in accordance with an operation of said switch.

40. A recording apparatus according to claim 38, further including detection means for detecting a type of material of the sheet to be fed, and wherein said control means controls said shifting means in accordance with a detection signal from said detection means.

41. A recording apparatus according to claim 36, wherein said feeding means is stopped when the sheet is fed by a predetermined distance, said recording means records the image on the sheet being stopped, and said urging member is positioned at an urging position where the sheet is urged against said guide during the recording operation and is positioned at a non-urging position where the sheet is not urged against said platen during the feeding of the sheet.

42. A recording apparatus according to claim 36, wherein said recording means records the image while shifting in a direction transverse to a width of the sheet when the sheet is fed by a predetermined distance, and said urging member is shifted, synchronously with the shifting of said recording means, from a non-urging position where the sheet is not urged against said guide to an urging position where the sheet is urged against said platen.

43. A recording apparatus according to claim 42, further including contacting means, movable integrally with said recording means, for shifting said urging member to the urging position by contacting said urging member.

44. A recording apparatus according to claim 43, wherein said contacting means comprises a rotary body contacting said urging member while rolling.

45. A recording apparatus according to claim 36, further including control means for stopping said feeding means after said feeding means feeds the sheet to a predetermined position where a leading end of the sheet can be urged by said urging member, and for controlling said urging member to urge the leading end of the sheet.

46. A recording apparatus according to claim 36, wherein said platen contacts the sheet downstream of the recording area.

47. A recording apparatus according to claim 46, wherein said platen does not contact the sheet at the recording area.

48. A recording apparatus according to claim 36, wherein said recording means comprises an ink jet head for discharging ink.

49. A recording apparatus according to claim 48, wherein said ink jet head records the image on the sheet with the ink discharged by thermal energy.

50. A recording apparatus according to claim 36, wherein said urging member includes a surface for contacting the sheet, and said surface comprises a water repelling feature.

51. A recording apparatus according to claim 36, further including a second urging member for urging the sheet against said platen between said feeding means and the recording area.

52. A recording apparatus according to claim 51, wherein said recording means records the image while shifting in a direction transverse to a width of the sheet when the sheet is fed by a predetermined distance, and said first and second urging members are shifted, synchronously with the shifting of said recording means, from a non-urging position where the sheet is not urged against said platen to an urging position where the sheet is urged against said platen.

53. A recording apparatus according to claim 52, further including contacting means, movable integrally with said recording means, for shifting said first and second urging members to the urging position by contacting said first and second urging members.

54. A recording apparatus according to claim 53, wherein said contacting means comprises first and second rotary bodies contacting said first and second urging members, respectively, while rolling.

55. A recording apparatus according to claim 54, wherein a first thickness of said first urging member in a direction substantially perpendicular to said platen is less than a second thickness of said second urging member in the direction substantially perpendicular to said platen.

56. A recording apparatus according to claim 51, wherein each of said first and second urging members comprises a plate shape.

57. A recording apparatus according to claim 36, wherein said urging member comprises a plate shape.

58. A recording apparatus, comprising:

a platen for supporting a sheet at a recording area thereof;

feeding means for feeding the sheet to said platen;

recording means for recording an image on the sheet at the recording area by adhering an ink to the sheet; and an urging plate, disposed downstream of the recording area, for urging the sheet against said platen, said urging plate having a water repelling surface abutted to the sheet, wherein said urging plate has a flat urging surface contacting the sheet, to urge the sheet against said platen by said flat urging surface while said recording means is adhering the ink to the sheet, wherein said urging plate is also switchable to a non-urging position when said recording means is adhering ink to the sheet.

59. A recording apparatus according to claim 58, further including shifting means for shifting said urging plate between an urging position where the sheet is urged against said platen and a non-urging position where the sheet is not urged against said platen.

60. A recording apparatus according to claim 59, further including operation means for activating said shifting means.

61. A recording apparatus according to claim 59, further including control means for controlling said shifting means to position said urging plate either at the urging position or at the non-urging position during a recording operation.

62. A recording apparatus according to claim 61, further including a switch, and wherein said control means controls said shifting means in accordance with an operation of said switch.

63. A recording apparatus according to claim 61, further including detection means for detecting a type of material of the sheet to be fed, and wherein said control means controls said shifting means in accordance with a detection signal from said detection means.

64. A recording apparatus according to claim 58, wherein said feeding means is stopped when the sheet is fed by a predetermined distance, said recording means records the image on the sheet being stopped, and said urging plate is positioned at an urging position where the sheet is urged against said platen during the recording operation and is positioned at a non-urging position where the sheet is not urged against said platen during the feeding of the sheet.

65. A recording apparatus according to claim 58, wherein said recording means records the image while shifting in a direction transverse to a width of the sheet when the sheet is fed by a predetermined distance, and said urging plate is shifted, synchronously with the shifting of said recording means, from a non-urging position where the sheet is not urged against said platen to an urging position where the sheet is urged against said platen.

66. A recording apparatus according to claim 65, further including contacting means, movable integrally with said recording means, for shifting said urging plate to the urging position by contacting said urging plate.

67. A recording apparatus according to claim 66, wherein said contacting means comprises a rotary body contacting said urging plate while rolling.

68. A recording apparatus according to claim 58, further including control means for stopping said feeding means after said feeding means feeds the sheet to a predetermined position where a leading end of the sheet can be urged by said urging plate, and for controlling said urging plate to urge the leading end of the sheet.

69. A recording apparatus according to claim 58, wherein said platen contacts the sheet downstream of the recording area.

70. A recording apparatus according to claim 69, wherein said platen does not contact the sheet at the recording area.

71. A recording apparatus according to claim 58, wherein said recording means comprises an ink jet head for discharging ink.

72. A recording apparatus according to claim 71, wherein said ink jet head records the image on the sheet with the ink discharged by thermal energy.

73. A recording apparatus according to claim 58, wherein said flat urging surface comprises a water repelling feature.

74. A recording apparatus according to claim 58, further including a second urging plate for urging the sheet against said platen between said feeding means and the recording area.

75. A recording apparatus according to claim 74, wherein said recording means records the image while shifting in a direction transverse to a width of the sheet when the sheet is fed by a predetermined distance, and said first and second urging plates are shifted, synchronously with the shifting of said recording means, from a non-urging position where the sheet is not urged against said platen to an urging position where the sheet is urged against said platen.

76. A recording apparatus according to claim 75, further including contacting means, movable integrally with said recording means, for shifting said first and second urging plates to the urging position by contacting said first and second urging plates.

77. A recording apparatus according to claim 76, wherein said contacting means comprises first and second rotary bodies contacting said first and second urging plates, respectively, while rolling.

78. A recording apparatus according to claim 77, wherein a first thickness of said first urging plate in a direction substantially perpendicular to said platen is less than a second thickness of said second urging plate in the direction substantially perpendicular to said platen.

* * * * *

UNITED STATES PATENT AND TRADEMARK OFFICE

CERTIFICATE OF CORRECTION

PATENT NO. : 5,673,074 
DATED : September 30, 1997
INVENTOR(S) : Yasuo MIYAUCHI, et al.

It is certified that error appears in the above-identified patent and that said Letters Patent is hereby corrected as shown below:

Title Page, [56] References Cited (second column):
Last entry ("41286"), delete "03/1994" and insert therefor --03/1984--.

Column 3, line 9, delete "in".

Column 4, line 19, after "longer", insert --required--.

Column 6, line 25, after "prevent", insert --of--;
Line 34, delete "portion" and insert therefor --portions--.

Column 12, line 37, after "with", insert --a--.

Column 14, line 31, delete "read record" and insert therefor --head records--;
Line 35, delete "read" and insert therefor --head--.

Column 15, line 11, delete "plate" and insert therefor --plates--;
Line 14, after "plates", insert a comma (",");
Line 23, delete"guide" and insert therefor --platen--.

UNITED STATES PATENT AND TRADEMARK OFFICE

CERTIFICATE OF CORRECTION

PATENT NO. : 5,673,074
DATED : September 30, 1997
INVENTOR(S) : Yasuo MIYAUCHI, et al.

It is certified that error appears in the above-identified patent and that said Letters Patent is hereby corrected as shown below:

Column 16, line 11, delete "21" and insert therefor --28--.

Column 17, lines 11 and 20, delete "guide", both occurrences, and insert therefor --platen--.

Signed and Sealed this

Twenty-fourth Day of March, 1998

*Attest:*

Bruce Lehman

BRUCE LEHMAN

*Attesting Officer*

*Commissioner of Patents and Trademarks*